US010499728B2

(12) United States Patent
Hansen et al.

(10) Patent No.: US 10,499,728 B2
(45) Date of Patent: Dec. 10, 2019

(54) FURNITURE FRAME FOR SECURING A FOLDABLE FURNITURE PILLAR

(71) Applicant: Kesseböhmer Produktions GmbH & Co. KG, Weilheim/Teck (DE)

(72) Inventors: Melf Hansen, Gondelsheim (DE); Michael Köder, Plochingen (DE)

(73) Assignee: KESSEBÖHMER PRODUKTIONS GMBH & CO. KG, Weilheim/Teck (DE)

( * ) Notice: Subject to any disclaimer, the term of this patent is extended or adjusted under 35 U.S.C. 154(b) by 0 days.

(21) Appl. No.: 15/756,850

(22) PCT Filed: Aug. 30, 2016

(86) PCT No.: PCT/EP2016/070409

§ 371 (c)(1),
(2) Date: Mar. 1, 2018

(87) PCT Pub. No.: WO2017/037059

PCT Pub. Date: Mar. 9, 2017

(65) Prior Publication Data

US 2018/0242728 A1 Aug. 30, 2018

(30) Foreign Application Priority Data

Sep. 2, 2015 (DE) ..... 10 2015 216 821

(51) Int. Cl.
*A47B 3/08* (2006.01)

(52) U.S. Cl.
CPC .... *A47B 3/0818* (2013.01); *A47B 2003/0821* (2013.01); *A47B 2003/0824* (2013.01)

(58) Field of Classification Search
CPC ..... A47B 3/0809; A47B 3/0818; A47B 2003/0821; A47B 2003/0824
(Continued)

(56) References Cited

U.S. PATENT DOCUMENTS 1,203,783 A * 11/1916 Reischmann ..... A47B 3/0815 108/132
2,318,945 A * 5/1943 Johannsen ..... A47B 3/0911 108/133

(Continued)

FOREIGN PATENT DOCUMENTS

DE 20 2006 011 855 U1 12/2007
DE 10 2011 076 409 A1 11/2012

(Continued)

OTHER PUBLICATIONS

International Search Report for Application No. PCT/EP2016/070409, dated Oct. 10, 2016 (5 Pages).

*Primary Examiner* — Jose V Chen
(74) *Attorney, Agent, or Firm* — Womble Bond Dickinson (US) LLP; John J. Penny, Jr.

(57) ABSTRACT

A frame of a furniture is disclosed, comprising a bearing, which is provided for rotatably mounting of a foldable pillar about an axis, and a fixation which is provided for receiving and fixing the foldable pillar. The frame is designed in a way, that fixing can be realized by clamping of a fixation equipped with an eccentric. Moreover a securing element is disclosed, which can be brought in a securing position by a lever, whereby the lever thereby simultaneously causes the pillar to be clamped in the frame.

6 Claims, 8 Drawing Sheets

(58) Field of Classification Search
USPC ..... 108/132, 131, 133, 129
See application file for complete search history.

(56) References Cited

U.S. PATENT DOCUMENTS

| | | | | | |
|---|---|---|---|---|---|
| 2,669,494 | A * | 2/1954 | Lenz, Sr. | A47B 3/0815 | 108/133 |
| 3,174,443 | A * | 3/1965 | Rothenbuhler | A47B 3/02 | 108/117 |
| 3,818,844 | A * | 6/1974 | Burr | A47B 3/0818 | 108/132 |
| 5,390,610 | A * | 2/1995 | Gutgsell | A47B 3/0911 | 108/132 |
| 5,528,997 | A * | 6/1996 | Miller | A47B 3/0912 | 108/131 |
| 5,638,761 | A * | 6/1997 | Berkowitz | A47B 3/0916 | 108/132 |
| 5,673,633 | A * | 10/1997 | Pfister | A47B 3/0815 | 108/131 |
| 5,941,181 | A * | 8/1999 | Hornberger | A47B 3/0911 | 108/131 |
| 5,957,062 | A * | 9/1999 | Cox | A47B 3/0815 | 108/133 |
| 6,202,571 | B1 * | 3/2001 | Pallares | A47B 3/0812 | 108/132 |
| 6,374,756 | B1 * | 4/2002 | Fieldwick | A47B 3/0918 | 108/131 |
| 6,745,804 | B2 * | 6/2004 | Welsh | B25H 1/04 | 144/287 |
| 7,107,915 | B2 * | 9/2006 | Laws | A47B 3/0812 | 108/130 |
| 7,249,563 | B2 * | 7/2007 | Chen | A47B 3/0815 | 108/129 |
| 7,509,914 | B2 * | 3/2009 | Murphy | A47B 3/0815 | 108/127 |
| 7,878,128 | B2 * | 2/2011 | Watson | A47B 3/0803 | 108/115 |
| 2003/0167980 | A1 * | 9/2003 | Suzuki | A47B 3/0815 | 108/129 |
| 2005/0235886 | A1 * | 10/2005 | Koning | A47B 3/0818 | 108/132 |
| 2006/0021553 | A1 * | 2/2006 | Pleiman | A47B 3/0815 | 108/133 |
| 2010/0175598 | A1 * | 7/2010 | Ballendat | A47B 3/0818 | 108/131 |

FOREIGN PATENT DOCUMENTS

| | | | |
|---|---|---|---|
| EP | 2 027 793 | A1 | 2/2009 |
| GB | 1895/15184 | A | 7/1896 |
| GB | 0 489 991 | A | 8/1938 |
| GB | 0 688 155 | A | 2/1953 |

* cited by examiner

FURNITURE FRAME FOR SECURING A FOLDABLE FURNITURE PILLAR

The present application claims priority under 35 U.S.C. § 119 to German Patent Application No. 10 2015 216 821.2 filed on Sep. 2, 2015 in Germany, and under 35 U.S.C. § 365 to PCT/EP2016/070409 filed on Aug. 30, 2016, the disclosures of which are incorporated herein by reference.

The present invention relates to a frame for securing a foldable furniture pillar, a furniture with the frame for securing a foldable furniture pillar, and a method for securing a foldable furniture pillar.

Furniture with foldable pillars are known from the state of the art, for example from the patent specification DE 10 2011 076 409 A1. Here, foldable furniture pillars are disclosed, which are rotatably positioned around a rotation axis R on a furniture frame by a fastening device 21. For securing the furniture pillar in an upright position, the pillar comprises a lug with a through hole 23 which aligns with a thread provided on the frame of the furniture, if the furniture pillar is in the upright position of the furniture. Subsequently, in this position, the furniture pillar may be secured on the frame (by means of the thread) by means of a screw (through the through hole 23), whereby a folding of the furniture pillar is obstructed. If such a furniture is set up at the final customer, the installer has to fold the furniture pillar in an upright position and secure the end position of the pillar by means of the mentioned screw. It is done by the installer screwing the screw into the thread of the frame through the lug of the pillar by means of a screwdriver or a cordless screwdriver. Consequently a tool like e.g. the mentioned manual screwdriver or a cordless screwdriver is needed for the setting up of such a furniture.

Furthermore, for the fixation of bicycle saddles or particularly bicycle rims on the bicycle frame, quick releases or quick release skewers are known. These comprise a lever, a connection bar with two clamping pieces, and an eccentric. Through the turning of the lever, the two clamping pieces are moved towards each other through a deflection of the eccentric, whereby e.g. a bicycle rim may be fixed on the bicycle frame by clamping. The level of tension can be adjusted in a way, that at least one clamping piece is connected to the connection bar by a thread, so that the relative position of the clamping piece on the connection bar can be adjusted by screwing it in, respectively by screwing it out (before bracing).

The object of the present invention is to provide a frame of a furniture, a furniture with a frame, and a method for securing a foldable pillar on a furniture, whereby the securing of the furniture pillar on the furniture is achievable without any tool.

This object is solved by a frame according to claim 1, a furniture according to claim 9 and a method according to claim 11.

Advantageous developments are dealt with in the dependent claims.

By designing the frame in the preferable manner, that the fixation of a pillar is achieved by clamping, no tool needs to be used for mounting e.g. a screw. Preferably the frame comprises a bearing through which the furniture pillar is fixed rotatable on the frame. This bearing is preferably realized in a way that a bolt or a screw is fixed in the frame and so fixes the pillar to the frame, but allows a rotational movement of the pillar around an axis with respect to the frame. If a furniture with the frame and the foldable pillars according to the invention is to be set up, the pillars are moved into an upright that means a vertical position (standard position). In this position the pillars need to be fixed to the frame, to ensure a secure footing. Preferably, the frame is designed in a way that the fixation is not performed by a screw or a bolt, but by clamping the pillar onto or into the frame. For this design the pillar is preferably jammed between two portions of the frame. The idea of the invention relates in general to the fact that the fixing of a possibility to rotate between a furniture and a rotating pillar fixed thereto is realized by the principle of jamming and clamping together at least two parts. By clamping, a clamping force is exerted between a frame and a foldable, respectively rotatable, pillar. Through this clamping force, a friction force is caused, which retains, respectively fixes, frame and pillar to one another. Preferably, the provided contact surfaces for clamping of pillar and frame exhibit a high friction coefficient. Preferably, specifically the coefficient of static friction of these surfaces are high.

Preferably, the frame comprises a fixation, which allows to be operated by one installer. By an appropriate operating of the fixation, a clamping effect can be achieved and sustained. Pillar and frame are movable into an upright position and subsequently fixable to one another due to the operating of the fixation. Through the preferable provision of the fixation, the fixing effect can be achieved by the installer without the utilization of tools.

Through the preferable provision of fixation on the frame and not on the foldable pillar, the process of setting up a foldable furniture is simplified to the effect that the pillar is easier and safer to be brought into the desired (upright) position due to a lower weight, which improves the handling of the set-up-process. If the fixation was mounted on the foldable pillar, such a structure would increase the weight of the pillar, whereby the erecting and holding of the pillar by an installer would be impeded. By preferably providing an eccentric, which moves a first and a second clamping piece towards one another through a connection piece and which thereby can clamp a part of the pillar positioned in between, a structure for clamping a component is feasible to very low costs. Additionally, such a structure is very easy to operate without using any tools.

Through the preferable provision of a foldable lever on the eccentric, a clamping effect can be achieved through the operation of the lever by an installer. Preferably, the frame is designed in a manner, such that the lever fixes the foldable pillar in a folded state that means in a state in which the pillar is folded onto the frame. Additionally, the frame is preferably designed in a manner such that the foldable pillar is not fixed on the frame, if the lever is folded away from the frame. In this way, it is easy to notice if the fixing state, respectively the fixing effect, of the fixation to a current time is established or not.

Preferably, the fixation at least provides a possibility to adjust the desired tension of the clamping. Because only if the tension of the fixing element is adjusted correctly and in a right way in the fixing position, a working set up process and a permanent securing respectively fixing of the foldable pillar on the frame of a furniture in the planned position can be ensured.

To avoid, that the foldable pillar moves out of the upright position despite of the fixed state (through clamping) and thus causing the folding of the furniture, preferably, a securing element is provided on the frame. This securing element is preferably mounted in or on the frame and preferably interferes (in a secure position) vertically to the moving direction of the foldable pillar with the foldable pillar and prevents a moving of the foldable pillar with respect to the frame. In a case in which a relative motion between frame and pillar would be triggered by an external force effect, a securing element secures the frame and the foldable pillar with respect to one another by positive engagement, whereby a motion of the foldable pillar and the frame with respect to one another is obstructed. While obstructing such a motion the securing element is exposed to shearing stress.

Preferably, the securing element is arranged in a way, such that it is movable into a securing position by a lever, which is provided for the operation of the eccentric, respectively the fixation. Preferably, the securing element is arranged in a way, such that it is held in a securing position by the lever of the fixation, if the lever is in the state folded onto the frame, in which the fixation clamps the foldable pillars in the frame. By means of such a design, the securing element is activated automatically as soon as the fixation is activated by operating the lever. In this way, activating the securing element cannot be forgotten by the installer. The securing element is preferably brought in a securing position by the lever if the latter triggers a tension of the fixation.

Preferably, the frame comprises a spring, which is arranged in a way that the securing element is pushed by the spring force in a position in which it doesn't secure the foldable pillars on the frame. In this way the securing element is deactivated automatically as soon as the lever of the fixation is moved by the installer into a position in which the clamping effect of the fixation is released.

FIG. 1 shows a view of the frame 1 with lever 125 from above, whereby the frame 1 is realized without securing element 13 and the lever 125 is in a state folded away from the frame 1 in which clamping is not exerted on the foldable pillar 2.

FIG. 2 shows a view of the frame 1 with lever 125 from above, whereby the frame is realized without securing element 13 and the lever 125 is in a state folded onto the frame 1 in which clamping is exerted.

FIG. 3 shows a view of the frame 1 with lever 125 from above, whereby the frame 1 is realized with securing element 13 and the lever 125 is in a state folded away from the frame 1, in which clamping is exerted.

FIG. 4 shows a view of the frame 1 with lever 125 from above, whereby the frame 1 is realized with securing element 13 and the lever 125 is in a state folded onto the frame 1 in which clamping is exerted and the securing element 15 engages with the pillar 2.

FIG. 5 shows a furniture in a perspective view, whereby the furniture comprises a frame 1 of the FIG. 1, respectively 2, whereby the pillars 2 are in an upright state, whereby the lever 125 is in a state folded onto the frame 1 by which clamping is exerted.

FIG. 6 shows the furniture of FIG. 5, whereby the pillars 2 are in a tilted state, whereby the lever 125 is in a state folded away from the frame 1 by which clamping is not exerted.

FIG. 7 shows a furniture in a perspective view, whereby the pillars 2 are in a tilted state, whereby the lever 125 is in a state folded away from the frame 1 by which clamping is not exerted.

FIG. 8 shows the embodiment described in FIG. 7 in the state shown in FIG. 6.

In the following the indications left/right/up/down will be used in the description of the figures. These are to be understood with respect to the orientation of the figures that the reference numbers can be read the right way up.

FIG. 1 shows the top view onto a frame 1. Further a tabletop 3 mounted on the frame 1 is not illustrated. In the left area of the illustration a crossbeam of the frame 1 extending from up to down is illustrated whereby in the middle and right area of the illustration a longitudinal beam of the frame 1 extending from right to left is illustrated. A bearing 11 mounts a foldable pillar 2 rotatable in the frame 1. The pillar 2 is set rotatable around the axis A within the frame 1 by the bearing 11. In the illustrated embodiment the bearing 11 is realized by a screw screwed into a provided thread in the pillar 2, whereby the frame 1 comprises through holes for inserting the shaft of the screw. A fixation 12 is formed in the shown embodiment by a first clamping element 121, a connection element 123, a second clamping element 122, an eccentric 124 and a lever 125. The connection element 123 comprises on its end directed away from the eccentric 124 an external thread, on which the first clamping element 121 is screwed. On the other end of the connection element 123, the eccentric 124 is arranged, whereby between the eccentric 124 and the frame 1 a second camping element 122 is added. This second clamping element 122 is not connected with the connection element 123, but merely runs on axial bearings on it. The second clamping element 122 comprises a round through hole for receiving the connection element 123. The eccentric 124 is integrally formed with a lever 125 as one piece. In the shown illustration, the lever 125 is in a position folded away from the frame 1. In this position of the lever 125, the eccentric 124 is aligned in a way that a clamping effect between the first clamping element 121 and the second clamping element 122 is not exerted. For exerting a clamping effect, the eccentric 124 is connected to the connection element 123 in a way, that the eccentric 124 is not movable on the axis of the connection element 123, whereby the eccentric 124 enlarges the distance between an axis protruding outwards of the plane of the sheet and the second clamping element 122 by twisting itself around the axis protruding outwards of the plane of the sheet, whereby the distance between the second clamping element 122, which is mounted movable in the axial direction on the connection element 123, and the first clamping element 121 gets smaller. In this way, a clamping effect between the first clamping element 121 and the second clamping element 122 occurs, whereby the frame 1 in the area of the first and the second clamping element 121, 122 is deformed elastically to a little extent and in this way exerts a pressing force against the foldable pillar 2. Thus, the foldable pillar 2 can be clamped within the frame 1.

FIG. 2 shows the embodiment of FIG. 1, whereby the lever 125 is in a state folded onto the frame 1, in which the eccentric 124 (as described above) is aligned in the way, that between the first clamping element 121 and the second clamping element 122 a clamping force is exerted by what the foldable pillar 2 is clamped within the part of the frame 1 extending from left to right, whereby the foldable pillar 2 is fixed within the frame 1.

The fixation 12 of the embodiment shown in FIG. 1 and FIG. 2 is movable in an axial direction along the connection element 123 through screwing the first clamping element 121 in, respectively out, of the thread. Therefore, the provided thread has a self-locking effect. The clamping effect, respectively the strength of the clamping effect, is adjustable by screwing the thread in the first clamping element 121 in, respectively out. This is because the distance of the first clamping element 121 and the second clamping element 122 is variable by screwing the first clamping element 121 in, respectively out, whereby the strength of the clamping effect is adjustable. The fixation 12 is released through the lever 125, the clamping strength can be adjusted by screwing the first clamping element 121 in, respectively out. If an installer feels that the lever runs too smooth or too tight, while turning the lever 125 for the fixation of the pillar, whereby the installer can conclude on the strength of the fixation, it is possible to adjust the clamping strength by screwing the first clamping element 121 in, respectively out.

In the embodiment shown in FIG. 3 the portions of frame 1 extending from left to right are implemented as double-walled. The design of the bearing 11 is identical to the preceding embodiments. However, the eccentric 124 is not axially fixed on the connection element 123, but movable along the axis of the connection element 123 between an adjusting element 126 and the second clamping element 122. The first clamping element 121 is screwed on the connection element 123 by a thread like in the preceding embodiments. In an embodiment, which is not illustrated, the first clamping element 121 is integrally formed with the connection element 123 as one piece or press-fitted on it. Furthermore, the adjusting element 126 on the other side of the connection element 123 is screwed on the latter by a self-locking thread. By screwing the adjusting element 126 in, respectively out, the distance between the adjusting element 126 and the first clamping piece 121 is variable, whereby the strength of the clamping effect of the eccentric 124 is adjustable. In the embodiment shown in FIG. 3, a lever 125 is in a state folded away from the frame 1, in which the eccentric doesn't exert a clamping effect on the foldable pillar 2. In the embodiment shown in FIG. 3, adjusting of the clamping effect by the thread in the adjusting element 126 is possible in contrast to the preceding embodiments, in which adjusting by the thread of the clamping element 121 is possible. In the embodiment shown in FIG. 3 the first clamping element 121 is permanently mounted in the frame 1.

Moreover, the embodiment shown in FIG. 3 comprises a securing element 13, which is guided through an opening in the frame 1 in an axial direction and pushed down by a spring 15 with respect to the illustration in FIG. 3. By exerting a force on the securing element 13 from down to up against the spring force, the mentioned securing element 13 is movable in an upwards direction, whereby it is insertable in a through hole, which is provided within the foldable pillar 2, into the foldable pillar 2.

FIG. 4 shows the embodiment illustrated in FIG. 3, whereby the lever 125 is in a position folded onto the frame 1, whereby the eccentric 124 (by pushing away from the adjusting element 126) exerts a clamping force on the pillar 2 by the first clamping element 121 and the second clamping element 122, whereby the foldable pillar is clamped within the frame 1. Moreover, the securing element 13 is pressed into the foldable pillar 2 against the spring force of the spring 15 by the position of the lever 125, whereby the foldable pillar 2 is secured in its position with respect to the frame 1 additionally to the clamping effect of the fixation 12.

If the lever 125 is turned from the position (clamping activated) of FIG. 4 into the position (clamping not activated) of FIG. 3, the spring 15 pushes the securing element 13 from the position shown in FIG. 4 (securing activated) into the position shown in FIG. 3 (securing not activated).

FIG. 5 shows a table with a tabletop illustrated transparently, whereby the table comprises a frame of the embodiment shown in FIGS. 1 and 2. Moreover, it can be seen, that's both sides of the table (left and right) are designed according to the idea of the invention. The table is in a set-up state, in which the foldable pillars are planned within the frame 1 by the fixations 12. Moreover the pillars 2 run on the bearing system 11 on the frame, but are not rotatable due to the activated fixations 12.

FIG. 6 shows the table of FIG. 5, whereby the pillars 2 are illustrated in a rotated state. Moreover the lever 125 is in a state folded away from the frame 1, whereby the clamping effect of the fixation 12 is released and consequently the pillars 2 can be folded away from the frame 1. In doing so, the pillars 2 are mounted on the frame 1 by means of the bearing system 11.

Figure 1:
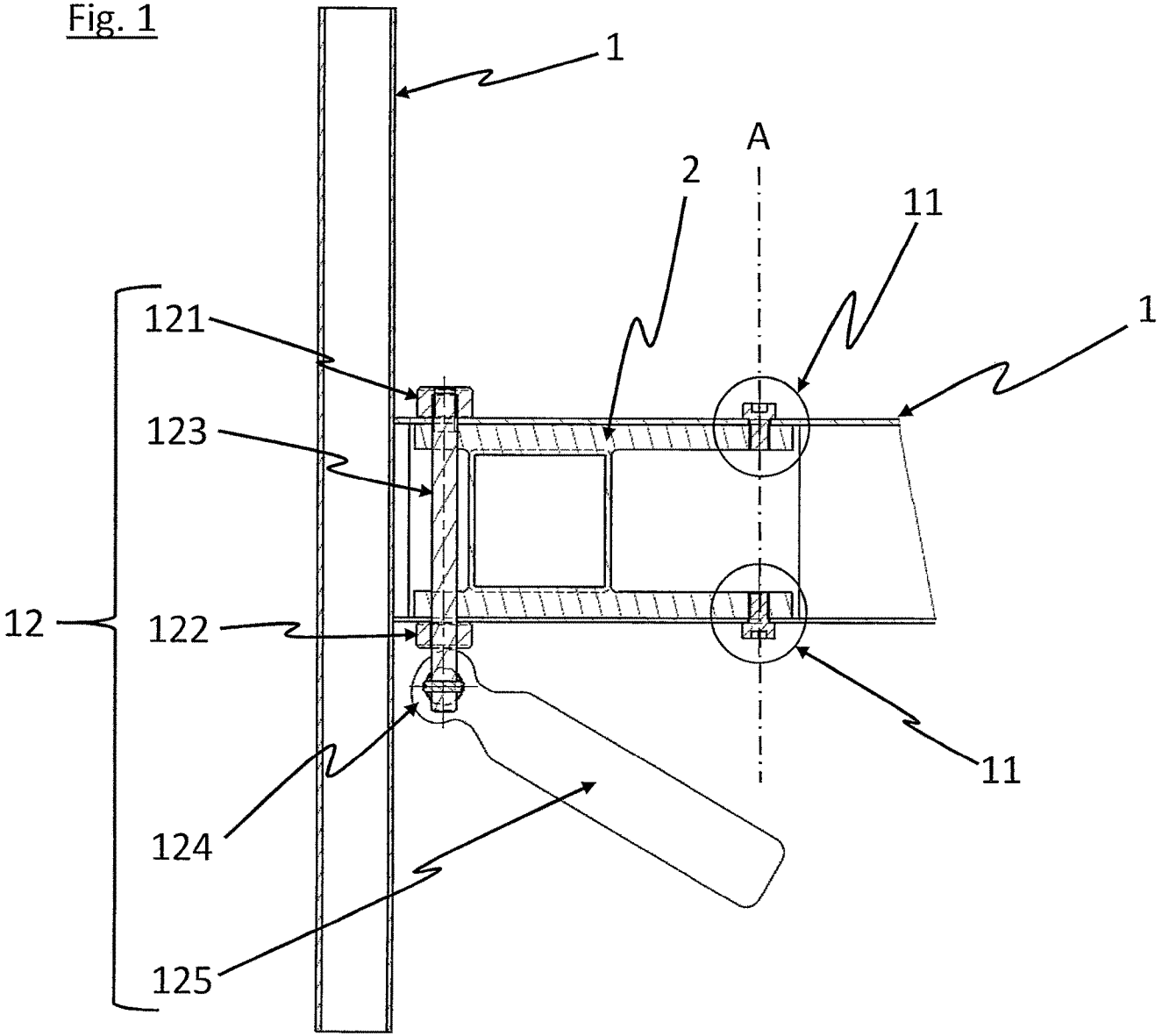
Figure 2:
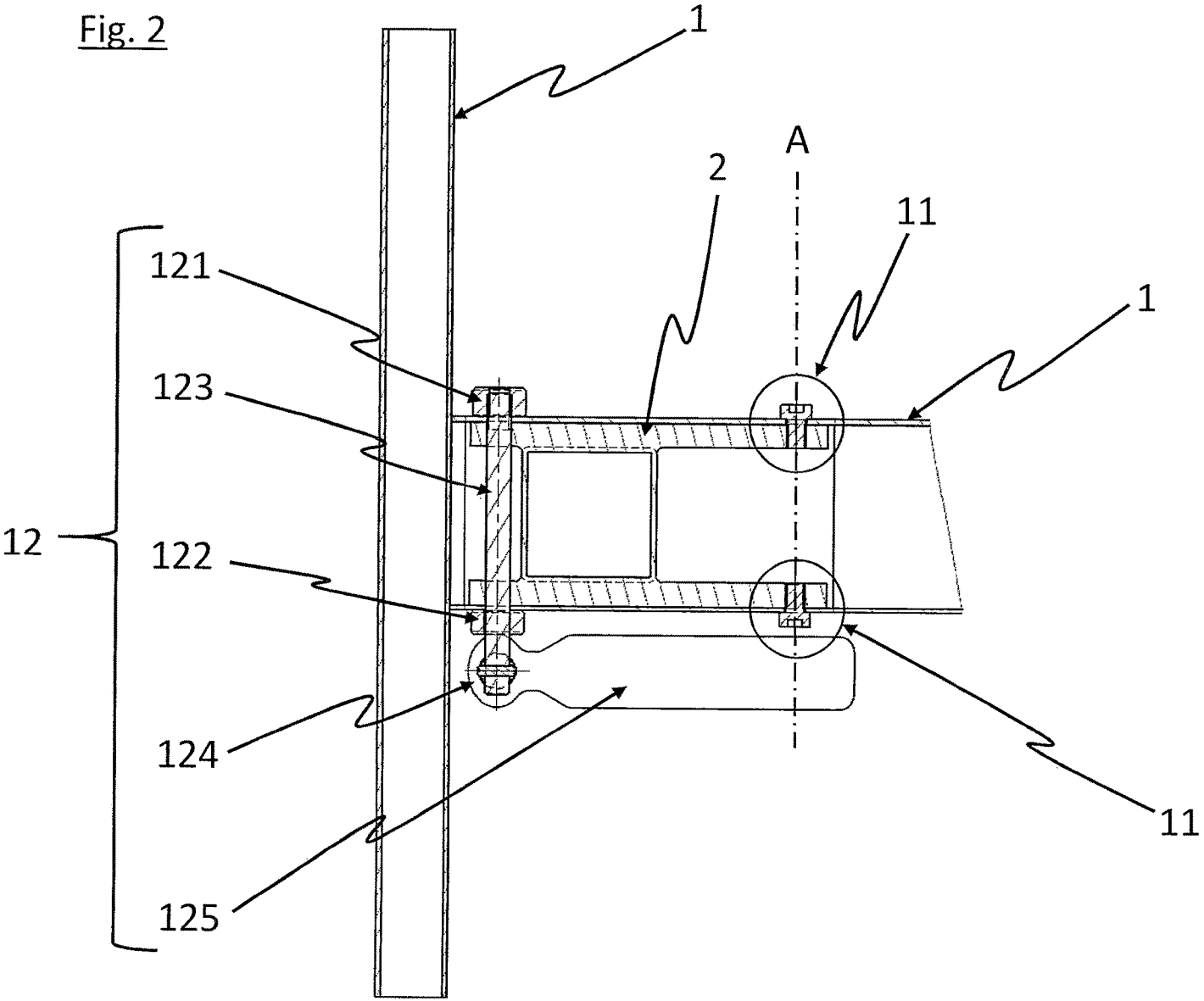
Figure 3:
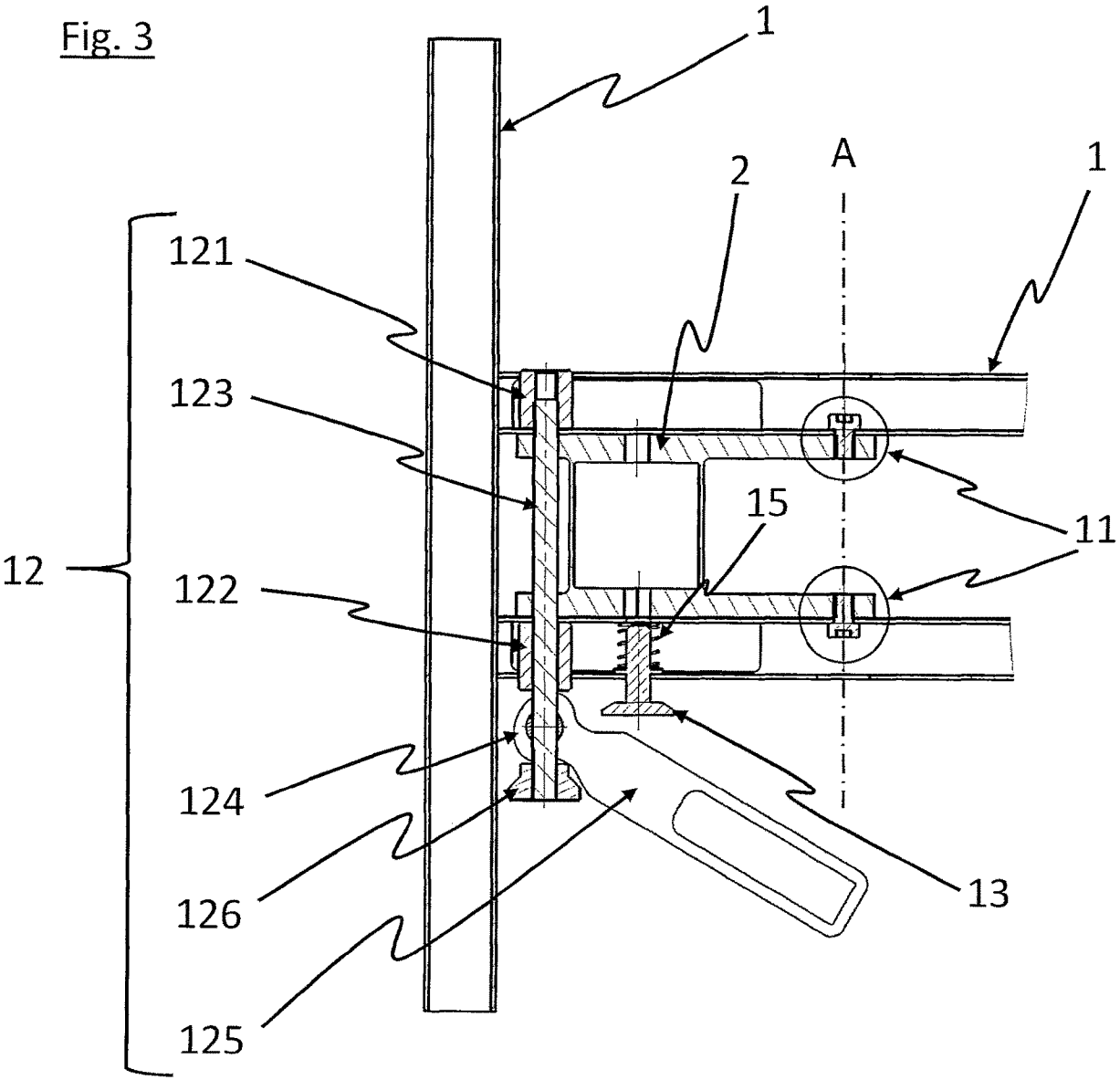
Figure 4:
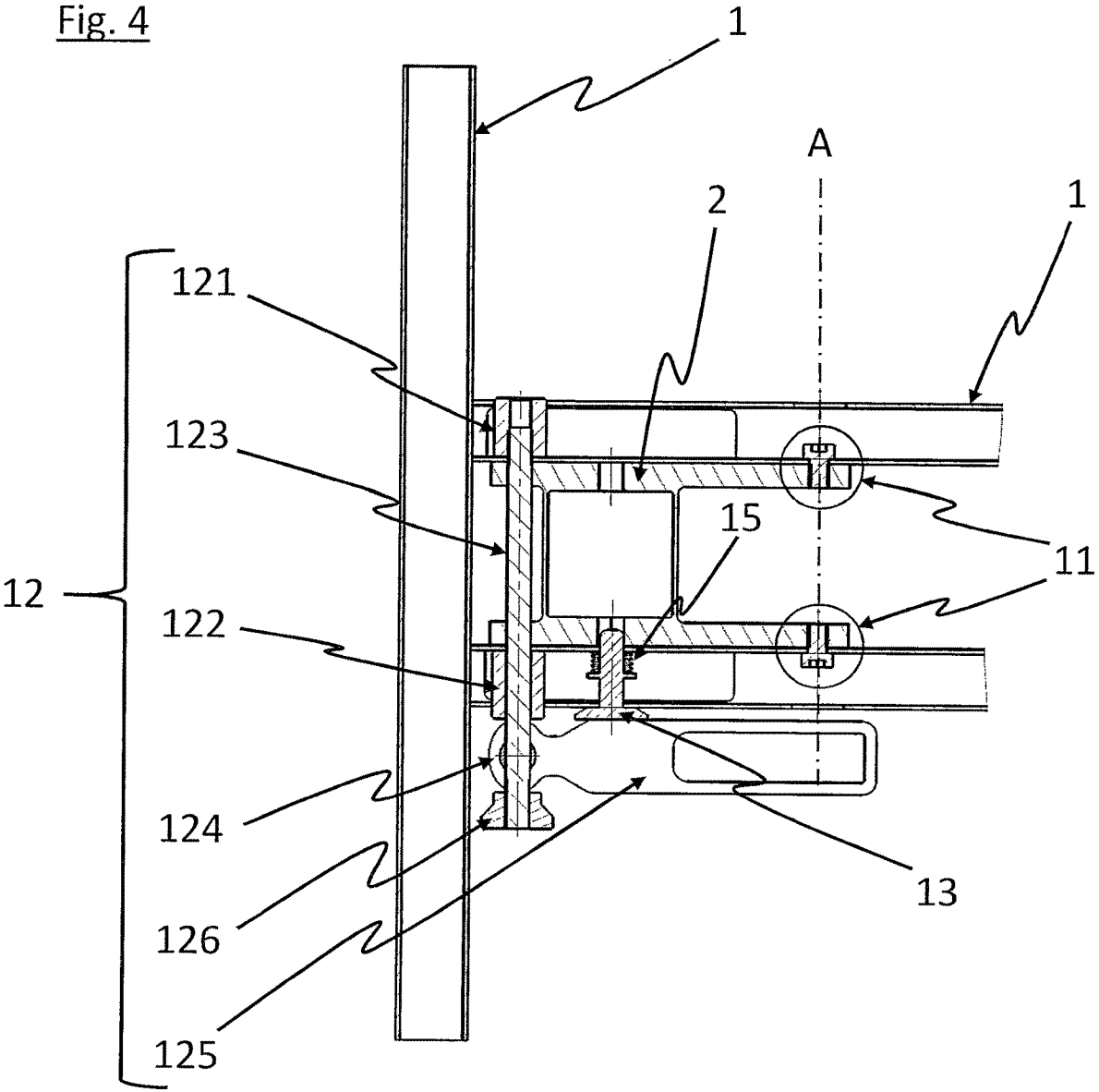
Figure 5:
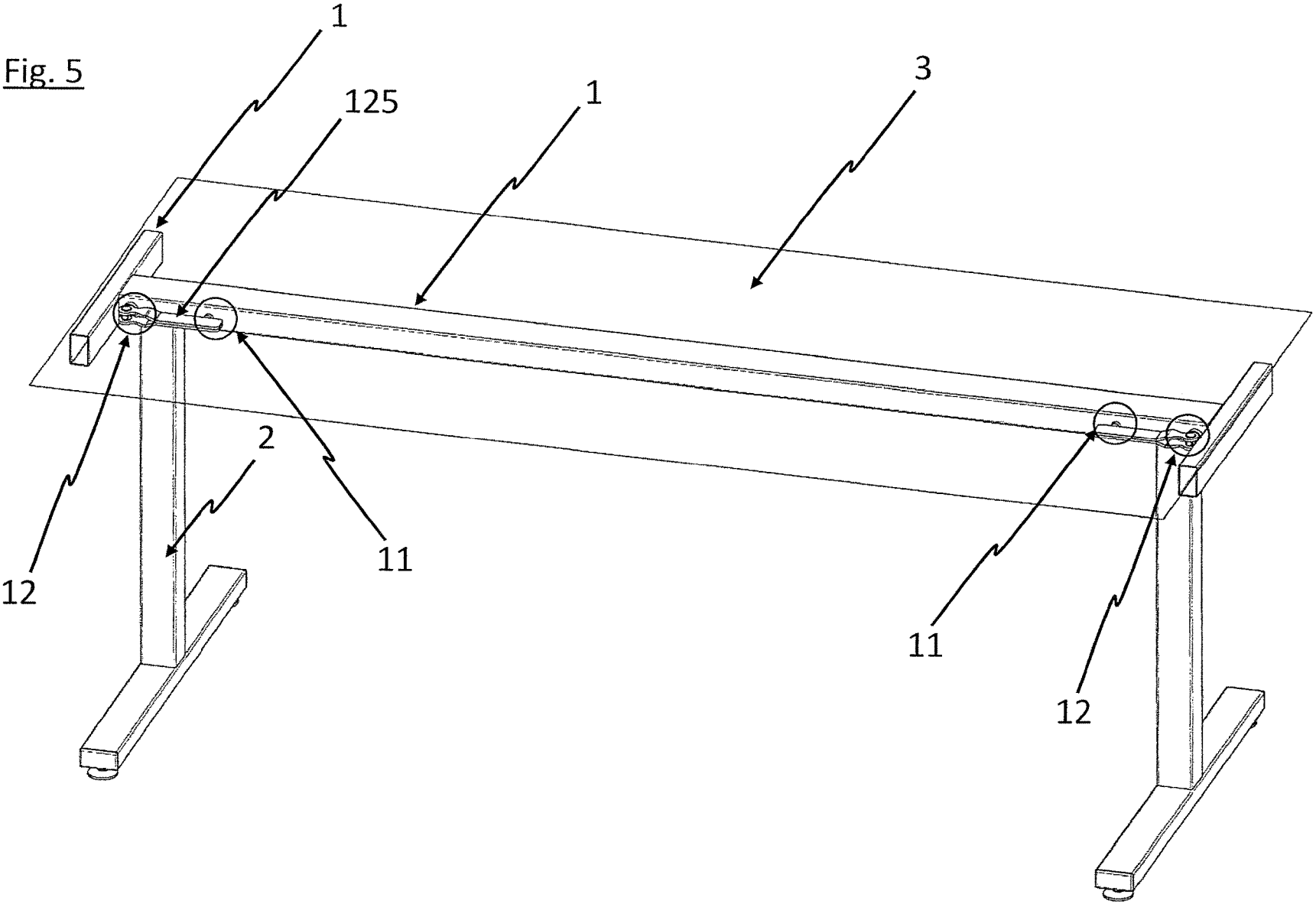
Figure 6:
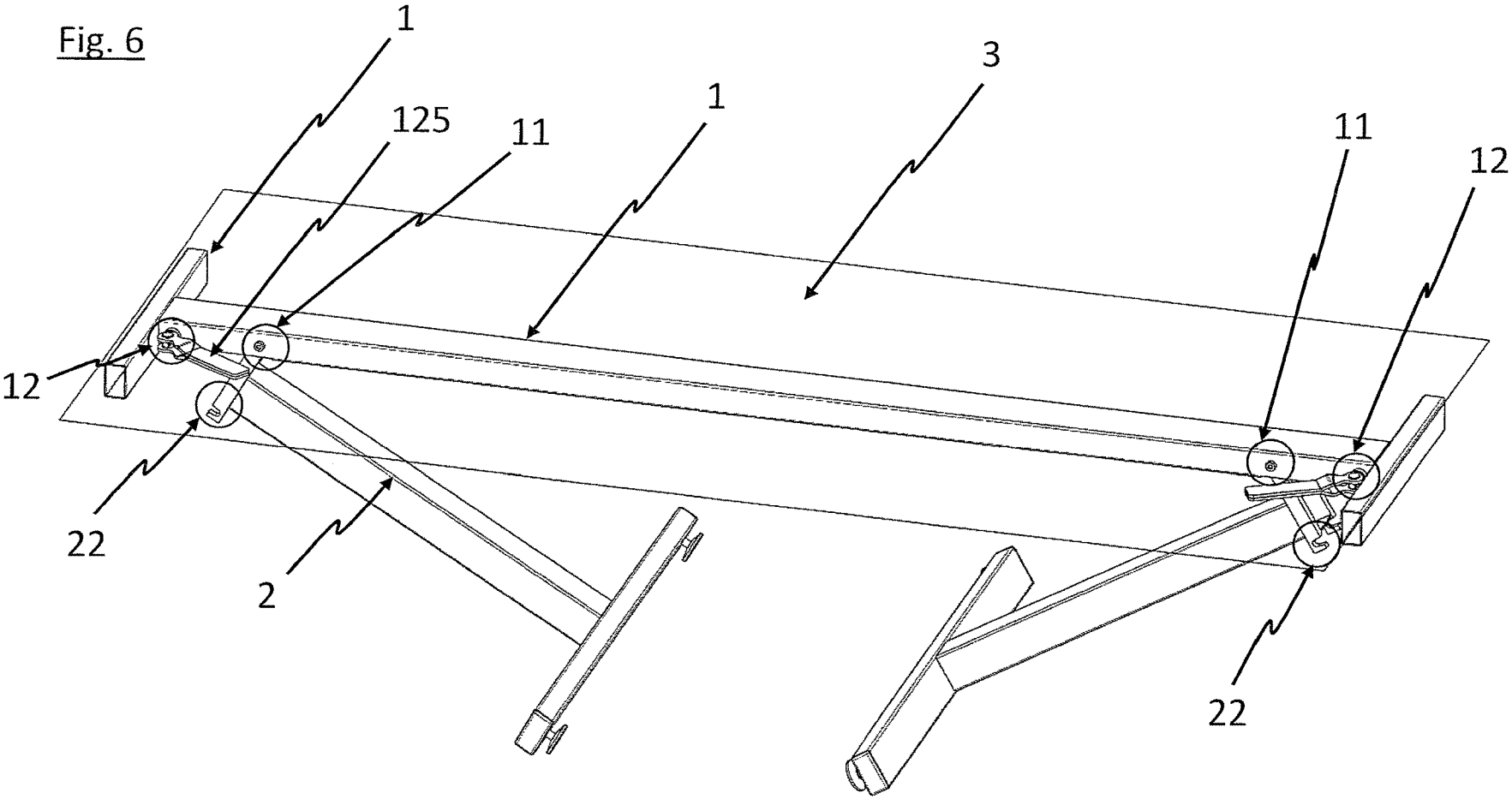
Figure 7:
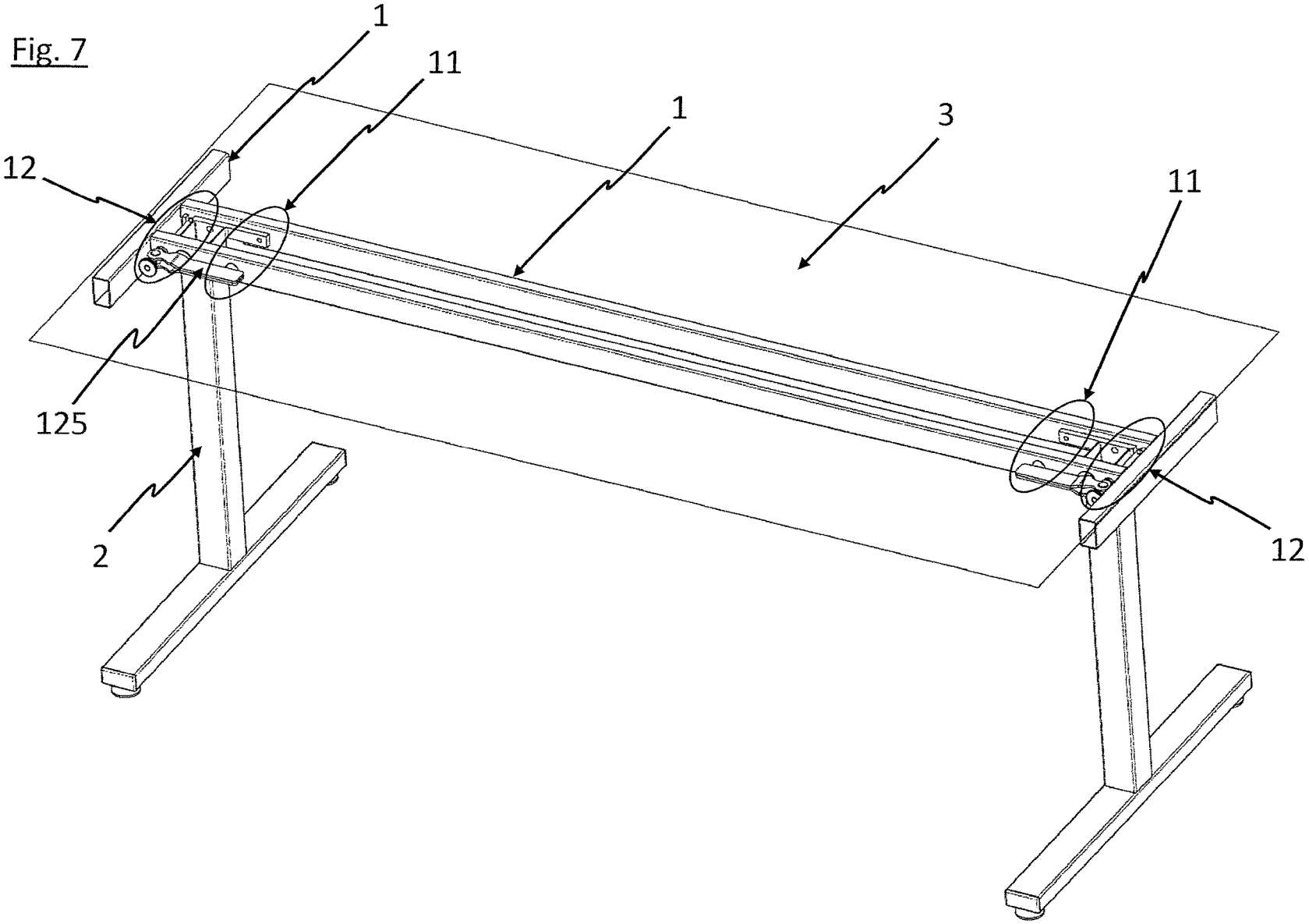
FIG. 7 shows an embodiment of a table in the state described in FIG. 5, whereby however the embodiment shown in FIGS. 3 and 4 is applied as frame 1.
Figure 8:
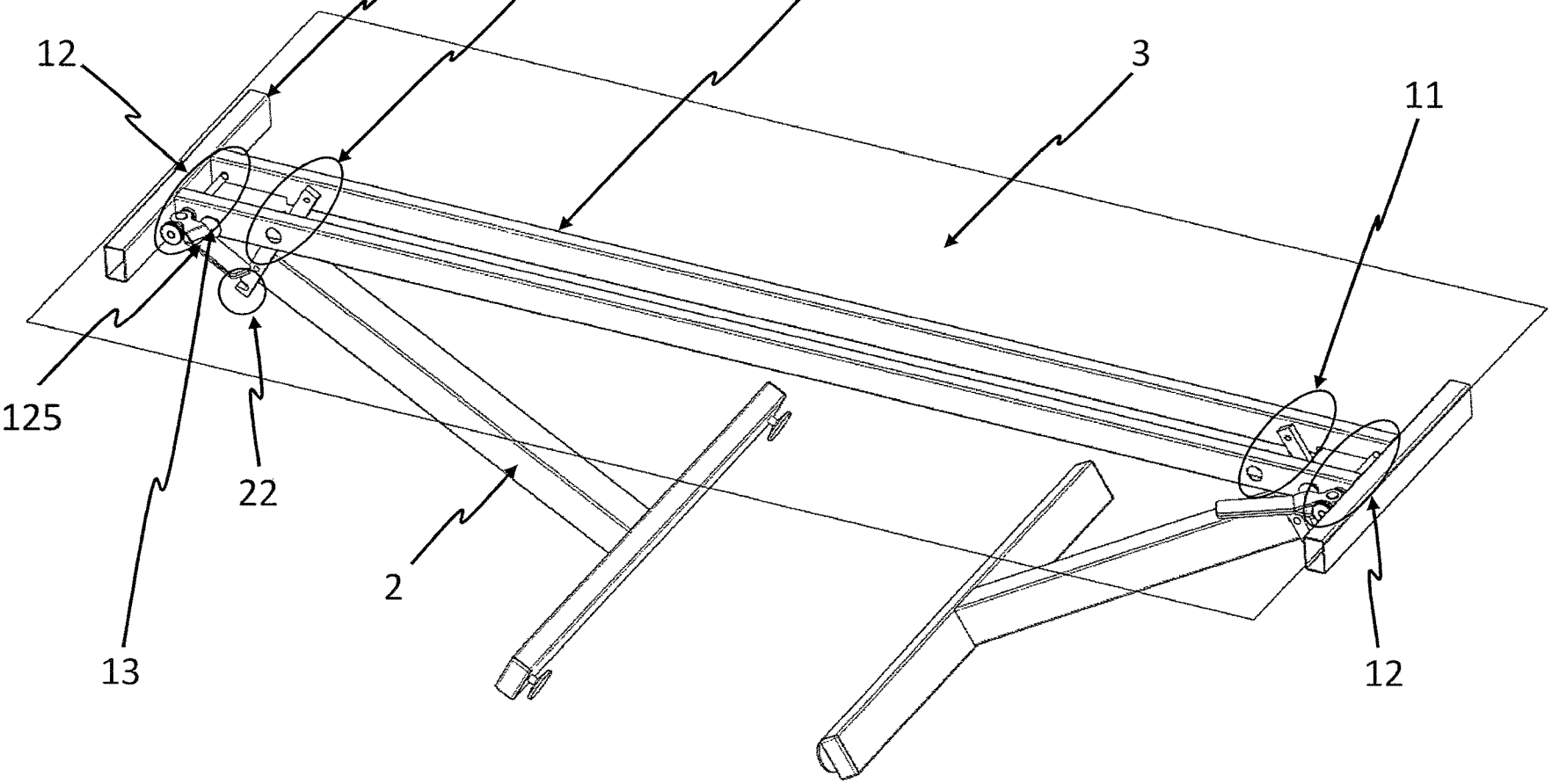
FIG. 8 shows the embodiment described in FIG. 7 in the state described in FIG. 6.

The invention claimed is:

1. A frame of a furniture, comprising:

a bearing system that rotatably supports a foldable pillar around an axis, a fixation that receives and fixes the foldable pillar, whereby the fixation fixes the foldable pillar by clamping, a securing element configured to secure the pillar in a predetermined position by positive engagement through meshing in a pin hole of the pillar, and a lever that presses the securing element into the pillar, wherein the fixation comprises:

a first clamping element connected to one end of a connection element;

a second clamping element loosely mounted on the connection element;

an adjusting element adjustably connected to another end of the connection element; and an eccentric movable along an axis of the connection element between the adjusting element and the second clamping element, wherein the distance between the adjusting element and the first clamping element is variable so that a strength of a clamping effect of the eccentric is adjustable.

2. The frame according to claim 1, wherein the frame is configured such that the foldable pillar can be clamped between at least two portions of the frame by the fixation.

3. The frame according to claim 1, wherein the securing element is configured to maintain a folded state in which the pillar is secured in the frame.

4. The frame according to claim 1, further comprising a spring, wherein the spring is positioned in a way that it acts on the securing element in a direction of a position that does not secure the pillar.

5. A furniture with a frame according to claim 1, wherein the foldable pillar comprises:

at least one round hole to allow the pillar to be rotatably mounted around an axis by means of the bearing system of the frame, and at least a U-shaped recess for receiving and fixing the pillar by means of the fixation of the frame.

6. A furniture according to claim 5, wherein the pillar further comprises a securing hole through which a securing element is inserted to secure the pillar.

* * * * *